US006686303B1

(12) United States Patent
Haynes et al.

(10) Patent No.: US 6,686,303 B1
(45) Date of Patent: Feb. 3, 2004

(54) BICOMPONENT NONWOVEN WEBS CONTAINING SPLITTABLE THERMOPLASTIC FILAMENTS AND A THIRD COMPONENT

(75) Inventors: Bryan David Haynes, Cumming, GA (US); Billy Dean Arnold, Alpharetta, GA (US); Justin Max Duellman, Little Rock, AR (US); Ryan Clinton Frank, Atlanta, GA (US); Jeffrey Lawrence McManus, Canton, GA (US); Charles Allen Smith, Snellvile, GA (US); Ty Jackson Stokes, Suwanee, GA (US); Kevin Edward Smith, Roswell, GA (US); Darryl Franklin Clark, Alpharetta, GA (US); Debra Jean McDowall, Roswell, GA (US); Samuel Edward Marmon, Alpharetta, GA (US); Christopher Cosgrove Creagan, Marietta, GA (US); Xin Ning, Alpharetta, GA (US); David Lewis Myers, Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 592 days.

(21) Appl. No.: 09/192,110

(22) Filed: Nov. 13, 1998

(51) Int. Cl.[7] ..... D04H 1/00; D04H 13/00; D04H 5/00; D04H 3/16; B32B 5/16

(52) U.S. Cl. ..... 442/327; 442/334; 442/352; 442/353; 442/356; 442/361; 442/362; 442/400; 442/401; 442/413; 442/414; 442/417

(58) Field of Search ..... 442/334, 362, 442/327, 352, 353, 356, 361, 400, 401, 413, 414, 417; 604/368; 428/221, 283

(56) References Cited

U.S. PATENT DOCUMENTS

| | | | | | |
|---|---|---|---|---|---|
| 3,338,992 | A | | 8/1967 | Kinney | 264/24 |
| 3,341,394 | A | | 9/1967 | Kinney | 161/72 |
| 3,485,706 | A | | 12/1969 | Evans | 161/72 |
| 3,502,538 | A | | 3/1970 | Petersen | 161/150 |
| 3,502,763 | A | | 3/1970 | Hartmann | 264/210 |
| 3,542,615 | A | | 11/1970 | Dobo et al. | 156/181 |
| 3,692,618 | A | | 9/1972 | Dorschner et al. | 161/72 |
| 3,802,817 | A | | 4/1974 | Matsuki et al. | 425/66 |
| 3,849,241 | A | | 11/1974 | Butin et al. | 161/169 |
| 3,855,046 | A | | 12/1974 | Hansen et al. | 161/150 |
| 3,901,236 | A | | 8/1975 | Assarsson et al. | 128/284 |
| 3,966,865 | A | | 6/1976 | Nishida et al. | 264/147 |
| 4,076,663 | A | | 2/1978 | Masuda et al. | 260/17.4 GC |
| 4,100,324 | A | | 7/1978 | Anderson et al. | 428/288 |
| 4,286,082 | A | | 8/1981 | Tsubakimoto et al. | 526/240 |
| 4,340,563 | A | | 7/1982 | Appel et al. | 264/518 |
| 4,369,156 | A | | 1/1983 | Mathes et al. | 264/147 |
| 4,530,353 | A | | 7/1985 | Lauritzen | 128/156 |
| 4,547,420 | A | | 10/1985 | Krueger et al. | 428/229 |
| 4,588,630 | A | | 5/1986 | Shimalla | 428/131 |
| 4,663,220 | A | * | 5/1987 | Wisneski et al. | 428/221 |
| 4,729,371 | A | | 3/1988 | Krueger et al. | 128/206.19 |
| 4,767,825 | A | | 8/1988 | Pazos et al. | 525/408 |
| 4,795,668 | A | | 1/1989 | Krueger et al. | 428/174 |
| 4,818,464 | A | | 4/1989 | Lau | 264/510 |
| 4,902,559 | A | | 2/1990 | Eschwey et al. | |
| 4,923,914 | A | | 5/1990 | Nohr et al. | 524/99 |
| 5,057,166 | A | | 10/1991 | Young, Sr. et al. | 156/62.2 |
| 5,064,689 | A | | 11/1991 | Young, Sr. et al. | 427/202 |
| 5,108,820 | A | | 4/1992 | Kaneko et al. | 428/198 |
| 5,147,343 | A | * | 9/1992 | Kellenberger | 604/368 |
| 5,225,014 | A | | 7/1993 | Ogata et al. | 156/73.2 |
| 5,230,959 | A | | 7/1993 | Young, Sr. et al. | 428/372 |
| 5,290,626 | A | | 3/1994 | Nishioi et al. | 428/224 |
| 5,302,447 | A | | 4/1994 | Ogata et al. | 428/288 |
| 5,336,552 | A | | 8/1994 | Strack et al. | 428/224 |
| 5,372,885 | A | | 12/1994 | Tabor et al. | 428/373 |
| 5,382,400 | A | | 1/1995 | Pike et al. | 264/168 |
| 5,424,115 | A | | 6/1995 | Stokes | 428/198 |
| 5,432,000 | A | | 7/1995 | Young, Sr. et al. | 428/372 |
| 5,511,960 | A | | 4/1996 | Terakawa et al. | 425/7 |
| 5,516,585 | A | | 5/1996 | Young, Sr. et al. | 428/372 |
| 5,670,044 | A | | 9/1997 | Ogata et al. | 210/497.01 |
| 5,672,419 | A | * | 9/1997 | Mukaida et al. | 428/283 |
| 5,679,042 | A | | 10/1997 | Varona | 442/347 |
| 5,681,305 | A | | 10/1997 | Korpman | 604/390 |
| 5,695,376 | A | * | 12/1997 | Datta et al. | 442/334 |
| 5,733,822 | A | * | 3/1998 | Gessner et al. | 442/35 |
| 5,759,926 | A | * | 6/1998 | Pike et al. | 442/333 |
| 5,866,488 | A | * | 2/1999 | Terada et al. | 442/362 |
| 5,981,410 | A | * | 11/1999 | Hansen et al. | 442/361 |
| 5,994,615 | A | * | 11/1999 | Dodge, II et al. | 604/378 |
| 6,022,818 | A | | 2/2000 | Welchel et al. | |
| 6,048,808 | A | * | 4/2000 | Kurihara et al. | 442/361 |
| 6,118,041 | A | * | 9/2000 | Roe et al. | 604/360 |
| 6,120,488 | A | * | 9/2000 | Vanrijswijck et al. | 604/385.28 |
| 6,120,783 | A | * | 9/2000 | Roe et al. | 424/402 |
| 6,142,985 | A | * | 11/2000 | Feist et al. | 604/385.29 |

FOREIGN PATENT DOCUMENTS

| | | |
|---|---|---|
| EP | 0 216 520 A2 | 8/1986 |
| JP | 4065568 | 3/1992 |
| JP | 7138866 | 5/1995 |
| WO | 98/03710 | 1/1998 |
| WO | WO 98/45519 | 10/1998 |

OTHER PUBLICATIONS

J.M.G.. Cowie: Polymers:*Chemistry and Physics of Modern Materials,*142–145, International Textbook Col, Ltd., 1973.

* cited by examiner

*Primary Examiner*—Terrel Morris
*Assistant Examiner*—Christopher C. Pratt
(74) *Attorney, Agent, or Firm*—Pauley Peterson & Erickson

(57) ABSTRACT

An improved nonwoven web composite is formed by combining splittable bicomponent thermoplastic filaments with a component selected from other fibers and particles. The bicomponent filaments include distinct regions of first and second incompatible polymers extending the length of the filaments. After the bicomponent filaments are combined with the other fibers and/or particles, the bicomponent filaments are caused to split lengthwise along boundaries between the regions of different polymers, resulting in a web or matrix of finer filaments which entrap, ensnare and contain the other fibers and/or particles within the web or matrix. The nonwoven web composite is particularly useful for making absorbent articles, which require durability and optimum levels of absorbent fibers and/or particles.

24 Claims, No Drawings

BICOMPONENT NONWOVEN WEBS CONTAINING SPLITTABLE THERMOPLASTIC FILAMENTS AND A THIRD COMPONENT

FIELD OF THE INVENTION

This invention relates to bicomponent nonwoven webs containing splittable thermoplastic filaments and a third component selected from fibers, particles and combinations thereof. The splitting of bicomponent filaments into smaller filaments helps to contain the third component, and may add softness to the composite product. Also, better capillary may result from the increased filament surface area.

BACKGROUND OF THE INVENTION

Bicomponent nonwoven filaments are known in the art generally as thermoplastic filaments which employ at least two different polymers combined together in a heterogeneous fashion. Instead of being homogeneously blended, two polymers may, for instance, be combined in a side-by-side configuration, so that a first side of a filament is composed of a first polymer "A" and a second side of the filament is composed of a second polymer "B." Alternatively, the polymers may be combined in a sheath-core configuration, so that an outer sheath layer of a filament is composed of a first polymer "A," and the inner core is composed of a second polymer "B." Alternatively, the polymers may be combined in an islands-in-the-sea configuration in which one or more islands of a first polymer "A" appear in a sea of a second polymer "B." Other heterogeneous configurations are also possible.

Splittable nonwoven bicomponent filaments are disclosed in U.S. Pat. No. 5,759,926, issued to Pike et al. These filaments contain at least two incompatible polymers arranged in distinct segments across the cross-section of each filament. The incompatible segments are continuous along the length of each filament. The individual segments of each filament split apart from each other when the filament is contacted with a hot aqueous fibrillation-inducing medium, resulting in finer individual filaments formed from the segments. Other techniques for splitting bicomponent filaments include mechanical agitation and spontaneous splitting caused by differential shrinkage of the components.

Bicomponent filaments have been disclosed in combination with carbon particles, zeolites, ion exchange resins, carbon fibers, stabilizing fibers, and/or gas absorbing fibers for use in specialized filters. U.S. Pat. No. 5,670,044, issued to Ogata et al., discloses the use of bicomponent meltblown filaments in these combinations, for use in cylindrical filters. In that case, the bicomponent filaments contain high and low melting polymers. The filaments of the filter are stacked and bonded together by melting only the lower melting component. However, Ogata et al. does not suggest splitting the bicomponent filaments.

Pulp fibers have been employed in certain absorbent applications, to enhance the absorbency. U.S. Pat. No. 4,530,353, issued to Lauritzen, discloses pulp fibers in combination with staple length bicomponent fibers used in the manufacture of absorbent bandages. In that case, the fibers also contain high and low melting polymers. The staple length fibers are bonded together by melting only the lower melting component. Again, there is no suggestion to split the bicomponent filaments.

In the field of absorbent articles, and other fields where thermoplastic nonwoven webs are combined with a third component selected from other fibers and/or particles, there is a need or desire for techniques which better contain the third component within the thermoplastic nonwoven filaments. There is also a need or desire for techniques which increase the maximum amount of the third component that can be ensnared, entangled, or otherwise contained within the matrix of thermoplastic nonwoven filaments.

SUMMARY OF THE INVENTION

The present invention is directed to an improved nonwoven composite wherein thermoplastic nonwoven filaments are utilized as a matrix for ensnaring, containing and restraining a component selected from other fibers and/or particles. The nonwoven composite provides improved containment of the other fibers and/or particles, and effectively contains higher levels of the other fibers and/or particles within a thermoplastic nonwoven filament matrix. The improved performance is accomplished using splittable thermoplastic bicomponent filaments, whose first and second polymers split apart into a larger number of finer filaments. The resulting finer filaments, in the increased number, provide better containment of the third component selected from other fibers and/or particles.

The present invention is also directed to an absorbent article, including a personal care absorbent article, which utilizes the improved nonwoven web composite of the invention.

The splittable bicomponent filaments contain at least first and second mutually incompatible thermoplastic polymer components, arranged in distinct segments across the width of the filament. Each polymer component is preferably continuous along the length of each splittable filament. Preferably, the splitting of the segments is controllable, so that the third component (other pulp or particles) can be combined relatively easily with the bicomponent filaments before they are split. Thereafter, the bicomponent filaments are responsive to a control mechanism which induces splitting of the filaments into finer filaments corresponding to each segment, to more firmly entrap and ensnare the third component within the matrix of thermoplastic filaments. Preferably, the splittable bicomponent filaments, and the thermoplastic segment components thereof, are substantially continuous in length.

With the foregoing in mind, it is a feature and advantage of the invention to provide an improved nonwoven web composite which exhibits improved containment of a third component selected from fibers and/or particles, within a matrix of thermoplastic nonwoven filaments.

It is also a feature and advantage of the invention to provide a nonwoven web composite having a latent controlled containment mechanism, which improves the ensnaring and entrapment of the third component after the third component enters the thermoplastic filament matrix.

It is also a feature and advantage of the invention to provide an absorbent article made using the improved nonwoven web composite.

Definitions

The term "nonwoven fabric or web" means a web having a structure of individual fibers or threads which are interlaid, but not in a regular or identifiable manner as in a knitted fabric. Nonwoven fabrics or webs have been formed from many processes such as, for example, meltblowing processes, spunbonding processes, air laying processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91.)

The term "microfibers" means small diameter fibers having an average diameter not greater than about 75 microns, for example, having an average diameter of from about 1 micron to about 50 microns, or more particularly, microfibers may have an average diameter of from about 1 micron to about 30 microns. Another frequently used expression of fiber diameter is denier, which is defined as grams per 9000 meters of a fiber. For a fiber having circular cross-section, denier may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by 0.89 g/cc and multiplying by 0.00707. Thus, a 15 micron polypropylene fiber has a denier of about 1.42 ($15^2 \times 0.89 \times 0.00707 = 1.415$). Outside the United States the unit of measurement is more commonly the "tex," which is defined as the grams per kilometer of fiber. Tex may be calculated as denier/9. The foregoing range refers to diameters existing before any splitting. The splitting of bicomponent microfibers would result in correspondingly smaller diameters.

The term "spunbonded fibers" refers to small diameter fibers which are formed by extruding molten thermoplastic material as filaments from a plurality of fine capillaries of a spinnerette having a circular or other configuration, with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,502,538 to Petersen, and U.S. Pat. No. 3,542,615 to Dobo et al., each of which is incorporated herein in its entirety by reference. Spunbond fibers are quenched and generally not tacky when they are deposited onto a collecting surface. Spunbond fibers are generally continuous and often have average diameters larger than about 7 microns, more particularly, between about 10 and 30 microns. Again, the splitting of bicomponent spunbonded fibers would result in correspondingly smaller diameters.

The term "meltblown fibers" means fibers formed by extruding a molten thermoplastic material through a plurality of fine, usually circular, die capillaries as molten threads or filaments into converging high velocity heated gas (e.g., air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed for example, in U.S. Pat. No. 3,849,241 to Butin. Meltblown fibers are microfibers which may be continuous or discontinuous, are generally smaller than 10 microns in diameter, and are generally self bonding when deposited onto a collecting surface. Meltblown fibers used in the present invention are preferably substantially continuous in length. Again, the splitting of bicomponent meltblown fibers would produce smaller diameter fibers.

The term "substantially continuous filaments or fibers" refers to filaments or fibers prepared by extrusion from a spinnerette, including without limitation spunbonded and meltblown fibers, which are not cut from their original length prior to being formed into a nonwoven web or fabric. Substantially continuous filaments or fibers may have average lengths ranging from greater than about 15 cm to more than one meter, and up to the length of the web or fabric being formed. The definition of"substantially continuous filaments or fibers" includes those which are not cut prior to being formed into a nonwoven web or fabric, but which are later cut when the nonwoven web or fabric is cut.

The term "staple fibers" means fibers which are natural or cut from a manufactured filament prior to forming into a web, and which have an average length ranging from about 0.1–15 cm, more commonly about 0.2–7 cm.

The term "personal care absorbent article" includes diapers, training pants, swim wear, absorbent underpants, baby wipes, adult incontinence products, and feminine hygiene products.

The term "bicomponent filaments or fibers" refers to fibers which have been formed from at least two polymers extruded from separate extruders but spun together to form one fiber. The polymers are arranged in substantially constantly positioned distinct zones across the cross-section of the bicomponent fibers and extend continuously along the length of the bicomponent fibers. The configuration of such a bicomponent fiber may be, for example, a sheath/core arrangement wherein one polymer is surrounded by another or may be a side-by-side arrangement or an "islands-in-the-sea" arrangement. Bicomponent fibers are taught in U.S. Pat. No. 5,108,820 to Kaneko et al., U.S. Pat. No. 5,336,552 to Strack et al., and U.S. Pat. No. 5,382,400 to Pike et al., each of which is incorporated herein in its entirety by reference. For two component fibers, the polymers may be present in ratios of 75/25, 50/50, 25/75 or any other desired ratios. Conventional additives, such as pigments and surfactants, may be incorporated into one or both polymer streams, or applied to the filament surfaces.

The term "splittable bicomponent filaments" refers to bicomponent filaments, as described above, which split lengthwise into finer filaments of the individual thermoplastic polymer segments when subjected to a stimulus. The term "controlled splitting" refers to subjecting these bicomponent filaments to a controlled stimulus or process which effects the lengthwise splitting at a selected time and place.

The term "pulp fibers" refers to fibers from natural sources such as woody and non-woody plants. Woody plants include, for example, deciduous and coniferous trees. Non-woody plants include, for instance, cotton, flax, esparto grass, milkweed, straw, jute hemp, and bagasse.

The term "average fiber length" refers to a weighted average length of fibers determined using a Kajaani fiber analyzer Model No. FS-100 available from Kajaani Oy Electronics in Kajaani, Finland. Under the test procedure, a fiber sample is treated with a macerating liquid to ensure that no fiber bundles or shives are present. Each fiber sample is dispersed in hot water and diluted to about a 0.001% concentration. Individual test samples are drawn in approximately 50 to 500 ml portions from the dilute solution and tested using the standard Kajaani fiber analysis procedure. The weighted average fiber lengths may be expressed by the following equation:

$$\sum_{X_i>0}^{k} (X_i * n_i)/n$$

where k=maximum fiber length, $X_i$=individual fiber length, $n_i$=number of fibers having length $X_i$ and n=total number of fibers measured.

The term "superabsorbent" or "superabsorbent material" refers to a water-swellable, water-insoluble organic or inorganic material capable, under the most favorable conditions, of absorbing at least about 20 times its weight and, more desirably, at least about 30 times its weight in an aqueous solution containing 0.9 weight percent sodium chloride.

The term "polymer" includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and atactic symmetries.

The term "incompatible polymers" indicates polymers that do not form a miscible blend, i.e., immiscible, when melt blended. As a desirable embodiment of the present invention, differences in the polymer solubility parameter ($\delta$) may be used to select suitably incompatible polymers. The polymer solubility parameters ($\delta$) of different polymers are well known in the art. A discussion of the solubility parameter is, for example, disclosed in *Polymer: Chemistry and Physics of Modern Materials*, pages 142–145, by J. M. G. Cowie, International Textbook Co., Ltd., 1973. Desirably, the adjacently disposed polymer components of the present conjugate fiber have a difference in the solubility parameter of at least about 0.5 $(cal/cm^3)^{1/2}$, more desirably at least about 1 $(cal/cm^3)^{1/2}$, most desirably at least about 2 $(cal/cm^3)^{1/2}$. The upper limit of the solubility parameter difference is not critical for the present invention as long as 1) the filaments do not split prematurely so as to interfere with spinning, and 2) there is adequate control over the splitting.

The term "through-air bonding" or "TAB" means a process of bonding a nonwoven, for example, a bicomponent fiber web in which air which is sufficiently hot to melt one of the polymers of which the fibers of the web are made is forced through the web. The air velocity is often between 100 and 500 feet per minute and the dwell time may be as long as 6 seconds. The melting and resolidification of the polymer provides the bonding. Through-air bonding has restricted variability and is generally regarded as a second step bonding process. Since TAB requires the melting of at least one component to accomplish bonding, it is restricted to webs with two components such as bicomponent fiber webs or webs containing an adhesive fiber or powder.

The term "thermal point bonding" involves passing a fabric or web of fibers to be bonded between a heated calender roll and an anvil roll. The calender roll is usually, though not always, patterned in some way so that the entire fabric is not bonded across its entire surface. As a result, various patterns for calender rolls have been developed for functional as well as aesthetic reasons. One example of a pattern has points and is the Hansen Pennings or "H&P" pattern with about a 30% bond area with about 200 bonds/square inch as taught in U.S. Pat. No. 3,855,046 to Hansen and Pennings. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern is the expanded Hansen and Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Another typical point bonding pattern designated "714" has square pin bonding areas wherein each pin has a side dimension of 0.023 inches, a spacing of 0.062 inches (1.575 mm) between pins, and a depth of bonding of 0.033 inches (0.838 mm). The resulting pattern has a bonded area of about 15%. Yet another common pattern is the C-Star pattern which has a bond area of about 16.9%. The C-Star pattern has a cross-directional bar or "corduroy" design interrupted by shooting stars. Other common patterns include a diamond pattern with repeating and slightly offset diamonds and a wire weave pattern looking as the name suggests, e.g., like a window screen. Typically, the percent bonding area varies from around 10% to around 30% of the area of the fabric laminate web. As is well known in the art, the spot bonding holds the laminate layers together as well as imparts integrity to each individual layer by bonding filaments and/or fibers within each layer.

DETAILED DESCRIPTION OF THE PRESENTLY PREFERRED EMBODIMENTS

The present invention is directed to a nonwoven web composite including a matrix of splittable bicomponent filaments containing at least a first thermoplastic polymer and a second thermoplastic polymer incompatible with the first, arranged in distinct zones across a cross-section of each filament. A third component, selected from fibers and/or particles, is contained within the bicomponent filament matrix.

The splittable bicomponent filaments may be substantially continuous or staple in length. Preferably, the splittable bicomponent filaments are substantially continuous. Substantially continuous filaments exhibit better containment of the third component, and provide better distribution of liquids, than staple length fibers.

The splittable bicomponent filaments are prepared in such fashion that the distinct segments of incompatible polymers generally extend the length of each filament. Any bicomponent configuration which achieves this result may be employed. For instance, the incompatible polymers may be arranged in a side-by-side configuration, or another suitable configuration. Examples of these and other suitable configurations are described in U.S. Pat. No. 5,759,926, issued to Pike et al., the disclosure of which is incorporated by reference.

Illustrative examples of particularly desirable pairs of incompatible polymers useful for the splittable bicomponent filaments include polyolefin with polyamide, e.g., polyethylene with nylon 6, polyethylene with nylon 6/6, polypropylene with nylon 6, polypropylene with nylon 6/6, polyethylene with a copolymer of caprolactam and alkylene oxide diamine, and polypropylene with a copolymer of caprolactam and alkylene oxide diamine; polyolefin with polyester, e.g., polyethylene with polyethylene terephthalate, polypropylene with polyethylene terephthalate, polyethylene with polybutylene terephthalate and polypropylene with polybutylene terephthalate; and polyamide with polyester, e.g., nylon 6 with polyethylene terephthalate, nylon 6/6 with polyethylene terephthalate, nylon 6 with polybutylene terephthalate, nylon 6/6 with polybutylene terephthalate, polyethylene terephthalate with a copolymer of caprolactam and alkylene oxide diamine, and polybutylene terephthalate with a copolymer of caprolactam and alkylene oxide diamine. Other incompatible polymers may also be employed, as well as blends thereof. For instance, the first polymer A may be a single polymer or multi-polymer blend, and the second polymer B may be a different single polymer or multi-component blend, so long as the polymer segments A and B are incompatible with each other. Additives, such as pigments and hydrophilic modifiers, may be incorporated into one or both polymers, or applied to the filament surfaces.

Generally, the splittable bicomponent thermoplastic filaments contain about 10–90% by weight of each of the first and second incompatible polymers. Preferably, each splittable filament includes about 25–75% by weight of each incompatible polymer, more preferably about 40–60% by weight of each incompatible polymer. When more than two incompatible polymer segments are present in the bicomponent filaments, the preferred weight percentages of each segment will be lower. The splittable bicomponent filaments may be produced using a spunbonding process, a meltblowing process, an air laying process, or another suitable process. The bicomponent filaments may have an average diameter of about 1–75 microns, preferably about 1–50 microns, more preferably about 1–30 microns, before splitting.

In one embodiment of the invention, the splittable bicomponent filaments can be characterized in that each splittable filament contains at least two incompatible component polymers and at least one of the component polymers is hydrophilic. In accordance with the present invention, the hydrophilic component polymer is a naturally hydrophilic polymer or a hydrophilically modified polymer. The term "hydrophilic" as used herein indicates affinity for water. The hydrophilicity ofthe hydrophilic component polymer can be measured in accordance with the ASTM D724-89 contact angle testing procedure on a film produced by melt casting the polymer at the temperature of the spin pack that is used to produce the conjugate fibers. Desirably, the hydrophilic polymer component has an initial contact angle less than about 90°, more desirably equal to or less than about 75°, even more desirably equal to or less than about 60°, most desirably equal to or less than about 50°. The term "initial contact angle" as used herein indicates a contact angle measurement made within about 5 seconds of the application of water drops on a test film specimen. The other polymer can be hydrophobic, as indicated by a contact angle of at least 90°.

Naturally hydrophilic polymers suitable for the present invention include thermoplastic polymers having the above-specified hydrophilicity. Such polymers include copolymers of caprolactam and alkylene oxide diamine, e.g., Hydrofil®, which are commercially available from Allied Signal Inc.; thermoplastic copolymers of poly(oxyethkylene) and polyurethane, polyamide, polyester or polyurea, e.g., absorbent thermoplastic polymers disclosed in U.S. Pat. No. 4,767,825 to Pazos et al.; ethylene vinyl alcohol copolymers; and the like. U.S. Pat. No. 4,767,825 in its entirety is herein incorporated by reference.

Hydrophilically modifiable polymers suitable for the present invention include polyolefins, polyesters, polyamides, polycarbonates and copolymers and blends thereof. Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene, and blends thereof; polybutylene, e.g., poly (1-butene) and poly(2-butene); polypentene, e.g., poly( 1-pentene) and poly(2-pentene); poly(3-methyl-1-pentene); poly(4-methyl-1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, and the like, as well as blends and copolymers thereof. Suitable polyesters include polyethylene terephthalate, polybutylene terephthalate, polytetramethylene terephthalate, polycyclohexylene-1,4-dimethylene terephthalate, and isophthalate copolymers thereof, as well as blends thereof.

In accordance with the present invention, when a hydrophobic or insufficiently hydrophilic polymer is used as the hydrophilic component of the splittable bicomponent fiber, the polymer must be hydrophilically or wettably modified. One useful means for modifying the polymer is adding a hydrophilic modifying agent or hydrophilic modifier that renders the polymer hydrophilic. Suitable hydrophilic modifiers include various surfactants. Depending on the final use of the split fiber material, the surfactants can be fugitive or nonfugitive. Fugitive surfactants, i.e., surfactants that wash off from the fiber surface, are suitable if the split fibers are used in single exposure applications or applications in which nonwettable or hydrophobic properties are desired, and nonfugitive surfactants, i.e., surfactants that permanently or semipermanently adhere to the fiber surface, are suitable if the split fibers are used in applications in which more durably wettable or hydrophilic properties are desired.

In addition, particularly suitable internally added surfactants are selected to have a low compatibility with the polymer of the hydrophilic component of the fiber since such surfactants readily migrate to the surface of the fiber during the fiber spinning process. When a surfactant having a slow migration characteristic is utilized, the fibers may need to be heat treated or annealed to facilitate the migration of the surfactant to the surface. Such heat treatment is known in the art as a "blooming" process. Illustrative examples of suitable surfactants include silicon based surfactants, e.g., polyalkylene-oxide modified polydimethyl siloxane, fluoroaliphatic surfactants, e.g., perfluoroalkyl polyalkylene oxides; and other surfactants, e.g., actylphenoxypolyethyoxy ethanol nonionic surfactants, alkylaryl polyether alcohols, and polyethylene oxides.

Commercially available surfactants suitable for the present invention include various alkylethoxylate based surfactants available under the tradename Triton, e.g., grade X-102, from Rohm and Haas Corp; various polyethylene glycol based surfactants available under the tradename Emerest, e.g., grades 2620 and 2650, from Emery Industries; various polyalkylene oxide modified polydimethylsiloxane based surfactants available under the tradename Masil, e.g., SF-19, which is available from BASF; polyalkylene oxide fatty acid derivatives available under the tradename MAPEG, e.g. MAPEG 400ML, which is available from PPG Industries; sorbitan monooleate, e.g., Span 80, which is available from ICI; ethoxylated hydroxylated castor oil, e.g., G1292, which is available from ICI; a mixture of sorbitan monooleate and ethoxylated hydroxylated castor oil, e.g., Ahcovel Base N62, which is available from Hodgson Textile Chemical Co.; polyoxyalkylene modified fluoroaliphatic surfactants which are available, e.g., from Minnesota Mining and Manufacturing Co.; and mixtures thereof.

The amount of surfactants required and the hydrophilicity of modified fibers for each application will vary depending on the type of surfactant and the type of polymer used. In general, fibers containing more hydrophilic or hydrophilically modified polymer components result in more spontaneous splitting. Consequently, a high level of a surfactant can be added to the polymer composition of the conjugate fibers provided that the surfactant level is not too high as to adversely affect the processibility of the polymer composition. Typically, the amount of the surfactant suitable for the present fiber composition is in the range of from about 0.1% to about 5%, desirably from about 0.3% to about 4%, by weight based on the weight of the polymer composition. The surfactant is thoroughly blended with the polymer composition before the composition is processed into fibers. For example, when a melt extrusion process for producing fibers is utilized, the surfactant is blended and melt extruded with the polymer compositions in extruders and then spun into fibers.

In accordance with the present invention, additional polymers for the bicomponent filaments may be present in the filaments so that, for instance, the filaments may split into three or more components instead of two. Suitable additional polymers include the above-illustrated hydrophilic polymers, hydrophobic polymers and modified hydrophobic polymers provided that they are incompatible with the other component polymers of the filaments, to facilitate splitting.

A wide variety of third component fibers and/or particles may be incorporated into the splittable bicomponent filament matrix, to make the improved nonwoven web composite of the invention. The nonwoven web composite includes about 5–97% by weight of the third component selected from fibers, particles, and combinations thereof, and about 3–95% by weight of the splittable bicomponent thermoplastic filaments. Preferably, the nonwoven web composite includes about 35–95% by weight of the third component and about 5–65% by weight of the splittable bicomponent thermoplastic filaments. More preferably, the nonwoven web composite includes about 50–95% by weight of the third component and about 5–50% by weight of the splittable bicomponent thermoplastic filaments.

Fibers which can be employed as the third component include, without limitation, absorbent fibers such as rayon staple fibers, cotton fibers, natural cellulose fibers such as wood pulp fibers and cotton linters, other pulp fibers, superabsorbents that are in fiber form, and combinations of the foregoing. Other useful fibers include fiberized feathers; for example, fiberized poultry feathers such as fiberized chicken feathers. Particles can be employed as the third component alone or in combination with fibers. Examples of useful particulate materials include, without limitation, activated charcoal, clays, starches, superabsorbents in particle form, and odor absorbents such as zeolites, yucca chitosan, and molecular sieve materials.

The splittable thermoplastic bicomponent nonwoven filaments may be combined with the third component materials using processes well known in the art. For example, a coform process may be employed, in which at least one meltblown diehead is arranged near a chute through which other materials are added while the web is forming. Coform processes are described in U.S. Pat. Nos. 4,818,464 to Lau and 4,100,324 to Anderson et al., the disclosures of which are incorporated by reference. The splittable thermoplastic bicomponent filaments and third component materials may also be combined using hydraulic entangling or mechanical entangling. A hydraulic entangling process is described in U.S. Pat. No. 3,485,706 to Evans, the disclosure of which is incorporated by reference. After combining the ingredients, the composite nonwoven web may be bonded together using the through-air bonding or thermal point bonding techniques described above, to provide a coherent high integrity structure.

Pulp fibers are especially useful as a third component when the composite nonwoven web is employed in an absorbent article. Preferred pulp fibers include cellulose pulp fibers. The pulp fibers may be any high average fiber length pulp, low average fiber length pulp, or mixtures of them.

The term "high average fiber length pulp" refers to pulp that contains a relatively small amount of short fibers and non-fiber particles. High fiber length pulps typically have an average fiber length greater than about 1.5 mm, preferably about 1.5–6 mm, as determined by an optical fiber analyzer, such as the Kajaani tester referenced above. Sources generally include non-secondary (virgin) fibers as well as secondary fiber pulp which has been screened. Examples of high average fiber length pulps include bleached and unbleached virgin softwood fiber pulps.

The term "low average fiber length pulp" refers to pulp that contains a significant amount of short fibers and non-fiber particles. Low average fiber length pulps have an average fiber length less than about 1.5 mm, preferably about 0.7–1.2 mm, as determined by an optical fiber analyzer such as the Kajaani tester referenced above. Examples of low fiber length pulps include virgin hardwood pulp, as well as secondary fiber pulp from sources such as office waste, newsprint, and paperboard scrap.

Examples of high average fiber length wood pulps include those available from the U.S. Alliance Coosa Pines Corporation under the trade designations Longlac 19, Coosa River 56, and Coosa River 57. The low average fiber length pulps may include certain virgin hardwood pulp and secondary (i.e., recycled) fiber pulp from sources including newsprint, reclaimed paperboard, and office waste. Mixtures of high average fiber length and low average fiber length pulps may contain a predominance of low average fiber length pulps. For example, mixtures may contain more than about 50% by weight low-average fiber length pulp and less than about 50% by weight high-average fiber length pulp. One exemplary mixture contains about 75% by weight low-average fiber length pulp and about 25% by weight high-average fiber length pulp.

The pulp fibers may be unrefined or may be beaten to various degrees of refinement. Crosslinking agents and/or hydrating agents may also be added to the pulp mixture. Debonding agents may be added to reduce the degree of hydrogen bonding if a very open or loose nonwoven pulp fiber web is desired. One exemplary debonding agent is available from the Quaker Chemical Company, Conshohocken, Pa., under the trade designation Quaker 2008. The addition of certain debonding agents in the amount of, for example, 1–4% by weight of the composite, may reduce the measured static and dynamic coefficients of friction and improve the abrasion resistance of the thermoplastic continuous polymer filaments. The debonding agents act as lubricants or friction reducers. Debonded pulp fibers are commercially available from Weyerhaeuser Corp. under the designation NB405.

In one highly advantageous embodiment, the third component includes a combination of pulp fibers and superabsorbent particles and/or fibers, to form a highly absorbent nonwoven web composite. The term "superabsorbent" or "superabsorbent material" refers to a water-swellable, water-insoluble organic or inorganic material capable, under the most favorable conditions, of absorbing at least about 20 times its weight and, more desirably, at least about 30 times its weight in an aqueous solution containing 0.9 weight percent sodium chloride.

The superabsorbent materials can be natural, synthetic and modified natural polymers and materials. In addition, the superabsorbent materials can be inorganic materials, such as silica gels, or organic compounds such as cross-linked polymers. The term "cross-linked" refers to any means for effectively rendering normally water-soluble materials substantially water insoluble but swellable. Such means can include, for example, physical entanglement, crystalline domains, covalent bonds, ionic complexes and associations, hydrophilic associations, such as hydrogen bonding, and hydrophobic associations or Van der Waals forces.

Examples of synthetic superabsorbent material polymers include the alkali metal and ammonium salts or poly(acrylic acid) and poly (methacrylic acid), poly(acrylamides), poly (vinyl ethers), maleic anhydride copolymers with vinyl ethers and alpha-olefins, poly(vinyl pyrrolidone), poly (vinylmorpholinone), poly(vinyl alcohol), and mixtures and copolymers thereof. Further superabsorbent materials include natural and modified natural polymers, such as hydrolyzed acrylonitrile-grafted starch, acrylic acid grafted starch, methyl cellulose, chitosan, carboxymethyl cellulose, hydroxypropyl cellulose, and the natural gums, such as alginates, xanthan gum, locust bean gum and the like. Mixtures of natural and wholly or partially synthetic superabsorbent polymers can also be useful in the present invention. Other suitable absorbent gelling materials are disclosed by Assarsson et al. in U.S. Pat. No. 3,901,236, issued Aug. 26, 1975. Processes for preparing synthetic absorbent gelling polymers are disclosed in U.S. Pat. No. 4,076,663, issued Feb. 28, 1978, to Masuda et al. and U.S. Pat. No. 4,286,082, issued Aug. 25, 1981, to Tsubakimoto et al.

Superabsorbent materials may be xerogels which form hydrogels when wetted. The term "hydrogel," however, has commonly been used to also refer to both the wetted and unwetted forms of the superabsorbent polymer material. The superabsorbent materials can be in many forms such as flakes, powders, particulates, fibers, continuous fibers, networks, solution spun filaments and webs. Particles can be of any desired shape, for example, spiral or semi-spiral, cubic, rod-like, polyhedral, etc. Needles, flakes, fibers, and combinations may also be used.

When used, the superabsorbent material may be present within the nonwoven composite in an amount from about 5 to about 90 weight percent based on total weight of the nonwoven composite. Preferably, the superabsorbent constitutes about 10–60% by weight of the nonwoven web composite, more preferably about 20–50% by weight. Superabsorbents are generally available in particle sizes ranging from about 20 to about 1000 microns. Examples of commercially available particulate superabsorbents include SANWET® IM 3900 and SANWET® IM-5000 P, available from Hoescht Celanese located in Portsmouth, Va., DRYTECH® 2035LD available from Dow Chemical Co., located in Midland, Mich., and FAVOR® 880, available from Stockhausen, located in Greensboro, N.C. An example of a fibrous superabsorbent is OASIS® 101, available from Technical Absorbents, located in Grimsby, United Kingdom.

In a preferred embodiment, the third component is combined with the thermoplastic bicomponent filaments before any splitting of the filaments is induced. After combining the ingredients together, the bicomponent filaments are split into finer filaments which better entrap, ensnare and contain the third component within the thermoplastic filament matrix. The splitting of the bicomponent filaments may then be effected using a variety of known techniques. When a hydrophilic material is used as one of the incompatible polymers, as described above, splitting may be accomplished without mechanical agitation using an aqueous split-inducing medium. A hot aqueous split-inducing medium is described in the above-identified U.S. Pat. No. 5,759,926.

Aqueous split-inducing media suitable for the invention include unheated as well as hot water. A desirable split-inducing media is hot water having a temperature of at least about 60° C., more desirably a temperature between about 65° C. and 100° C. Additionally, suitable media are steam and mixtures of steam and air that have a temperature higher than 60° C. but lower than the melting point of the lowest melting polymer of the bicomponent fiber in order to prevent inadvertent melting of the polymer components during the fiber splitting process. When an air and steam mixture medium is utilized, the temperature of the air, which is mixed with steam, can be adjusted to change the temperature of the split-inducing medium. For example, the temperature of the air can be elevated to further increase the temperature of the steam-air mixture.

In a preferred embodiment, the splittable conjugate fibers split in a time frame equal to or less than about 30 seconds; desirably equal to or less than about 10 seconds; more desirably equal to or less than 5 seconds; most desirably less than equal to or less than 1 seconds, e.g., nearly instantaneous, when contacted with the split-inducing medium. In addition, at least about 25%, desirably at least about 50%, more desirably at least about 75%, most desirably at least about 95% and up to 100% of the conjugate fiber splits with the present fiber splitting process.

The aqueous fiber splitting process provides various ways to control the extent of fiber splitting. For example, the hydrophilicity of the components for the bicomponent fibers can be adjusted, the temperature of the aqueous split-inducing medium can be adjusted, or the duration of exposure to the split-inducing medium can be controlled to regulate the extent of fiber splitting. The hydrophilicity of the compositions can be simply adjusted by selecting polymers with varying levels of inherent hydrophilicity and by varying the level of addition and/or changing the type of the hydrophilic modifier when such a modifier is used.

The splittable bicomponent fibers need not be conventional round fibers. Other useful fiber shapes include rectangular, oval and multilobal shapes and the like. Thin rectangular fibers and multilobal fibers are particularly suitable for the present invention. The thin rectangular or multilobal shape of the bicomponent fiber provides a higher surface area that can be exposed to the split-inducing medium, better facilitating splitting of the fiber. Consequently, compared to conventional round fibers, the rectangular or multilobal bicomponent fibers split more easily when subjected to the split-inducing medium.

The splittable fibers may be crimped or uncrimped. Crimped splittable bicomponent fibers of the present invention are highly useful for producing lofty woven and nonwoven fabrics since the fine fibers split from the bicomponent fibers largely retain the crimps of the bicomponent fibers and the crimps increase the bulk or loft of the fabric. Such lofty fine fiber fabric of the present invention exhibits cloth-like textural properties, e.g., softness, drapability and hand, as well as desirable strength properties of a fabric containing highly oriented fibers. As for uncrimped split fiber fabrics, such fabrics provide improved uniform fiber coverage and strength properties as well as improved hand and texture.

An elastic polymer may be combined with an inelastic polymer in side-by-side splittable bicomponent filaments to produce splittable bicomponent filaments having a tendency to crimp. The crimped bicomponent filaments may be in the form of meltblown microfibers, which are relatively fine and flexible, to help entangle the third component. The crimped bicomponent filaments may also be spunbond filaments, for added loft and resilience. Crimped splittable bicomponent filaments can be used with or without other thermoplastic filaments in a nonwoven web to provide enhanced bulk and lower web density.

Exemplary elastic materials, useful for producing splittable crimped bicomponent filaments, include without limitation the following. These materials may be extruded along with a second (incompatible) polymer which is a) inelastic, and b) preferably has hydrophilic properties, for the reasons explained above.

Relatively Elastic Polymers

Styrene-butadiene copolymer
Elastomeric (single site or metallocene catalyzed) polypropylene
Elastomeric (single site or metallocene catalyzed) polyethylene
Polyurethane
Ethylene vinyl acetate copolymer
Ethylene propylene rubber In addition to combinations of relatively elastic and relatively inelastic polymers, other polymer combinations can be employed to achieve crimping. For instance, crimping may be achieved using combinations of relatively heat shrinkable polymers (polymers whose filaments shrink upon secondary heating to a temperature below the melting peak) with relatively non-heat shrinkable polymers in the splittable bicomponent thermoplastic filaments. Exemplary heat shrinkable polymers include without limitation the following:

Relatively Heat Shrinkable Polymers

Polyethylene terephthalate
Polybutylene terephthalate
Ethylene vinyl acetate copolymer Various other improvements and embodiments are also considered to be within the scope of the invention. In another embodiment, the splittable bicomponent thermoplastic filaments may be combined with other thermoplastic filaments in addition to the third component. For instance, the splittable bicomponent thermoplastic filaments may include a mixture of bicomponent spunbond filaments and bicomponent meltblown filaments. In this embodiment, the spunbond filaments impart greater strength and the meltblown filaments are more effective in capturing and entangling the pulp fibers. In still another embodiment, the splittable bicomponent filaments may be spunbond and mixed with meltblown fibers (not necessarily bicomponent) which have a relatively low melting point. The composite web may thus be formed by combining three or more streams of bicomponent spunbond filaments, lower melting meltblown filaments and third component (particles and/or fibers). The meltblown filaments may still be hot and tacky when the third component particles and/or fibers are introduced, and may fuse with the third component to help consolidate the structure. Meltblown microfibers, which typically have diameters much smaller than spunbond fibers, may in effect serve as a binder or adhesive for the third component particles and/or fibers.

The improved nonwoven composite of the invention can be used in a wide variety of absorbent products including, without limitation, personal care absorbent articles. Personal care absorbent articles include diapers, training pants, swim wear, absorbent underpants, baby wipes, adult incontinence products, feminine hygiene products, and the like. The absorbent nonwoven composite is particularly useful in diapers, wherein the splittable bicomponent filaments contribute softness, bulk and durability, as well as excellent retention of the third component, which may include a combination of pulp fibers and superabsorbent. Other absorbent articles which may utilize the nonwoven composite of the invention include without limitation, absorbent medical products, including underpads, bandages, absorbent drapes, and medical wipes which contain alcohol and/or other disinfectants.

While the embodiments of the invention described herein are presently considered preferred, various modifications and improvements can be made without departing from the spirit and scope of the invention. The scope of the invention is indicated by the appended claims, and all changes within the meaning and range of equivalents are intended to be embraced therein.

We claim:

1. A nonwoven web composite, comprising:

a matrix including filaments formed by splitting bicomponent thermoplastic filaments, the bicomponent filaments including a first thermoplastic polymer and a second thermoplastic polymer arranged in distinct zones across a cross-section of individual bicomponent filaments;

the first and second thermoplastic polymers being incompatible with each other and responsive to a nonmechanical stimulus to induce separation from each other; and a third component contained within the matrix, the third component selected from the group consisting of fibers, particles, and combinations thereof.

2. The nonwoven web composite of claim 1, wherein the first and second thermoplastic polymers are arranged in a side-by-side configuration.

3. The nonwoven web composite of claim 1, wherein the bicomponent thermoplastic filaments comprise substantially continuous filaments.

4. The nonwoven web composite of claim 1, wherein the bicomponent thermoplastic filaments comprise spunbond filaments.

5. The nonwoven web composite of claim 1, wherein the bicomponent thermoplastic filaments comprise meltblown filaments.

6. The nonwoven web composite of claim 1, wherein the first thermoplastic polymer comprises a hydrophobic polymer and the second thermoplastic polymer comprises a hydrophilic polymer.

7. The nonwoven web composite of claim 1, wherein the first thermoplastic polymer comprises a polyolefin and the second thermoplastic polymer comprises a polyamide.

8. The nonwoven web composite of claim 1, wherein the first thermoplastic polymer comprises a polyolefin and the second thermoplastic polymer comprises a polyester.

9. The nonwoven web composite of claim 1, wherein the first thermoplastic polymer comprises a polyamide and the second thermoplastic polymer comprises a polyester.

10. The nonwoven web composite of claim 1, wherein at least one of the first and second thermoplastic polymers comprises a polymer blend.

11. The nonwoven web composite of claim 1, wherein the bicomponent thermoplastic filaments comprise crimped filaments.

12. The nonwoven web composite of claim 11, wherein the first thermoplastic polymer comprises a relatively elastic polymer and the second thermoplastic polymer comprises a relatively inelastic polymer.

13. The nonwoven web composite of claim 1, wherein the first thermoplastic polymer comprises a relatively heat shrinkable polymer and the second thermoplastic polymer comprises a relatively non-heat shrinkable polymer.

14. The nonwoven web composite of claim 1, wherein the filament matrix comprises a mixture of spunbond and meltblown filaments.

15. The nonwoven web composite of claim 1, wherein the third component comprises absorbent fibers selected from the group consisting of rayon fibers, cotton fibers, pulp fibers, superabsorbent fibers, fiberized feathers, and combinations thereof.

16. The nonwoven web composite of claim 1, wherein the third component comprises particles selected from the group consisting of charcoal, clays, starches, superabsorbent particles, odor absorbents, and combinations thereof.

17. The nonwoven web composite of claim 1, wherein the third component comprises pulp fibers and a superabsorbent.

18. The nonwoven web composite of claim 1, comprising about 3–95% by weight of the filament matrix and about 5–97% by weight of the third component.

19. The nonwoven web composite of claim 1, comprising about 5–65% by weight of the filament matrix and about 35–95% by weight of the third component.

20. The nonwoven web composite of claim 1, comprising about 5–50% by weight of the filament matrix and about 50–95% by weight of the third component.

21. A nonwoven web composite, comprising:

a matrix including filaments formed by splitting bicomponent thermoplastic filaments, the bicomponent filaments including a first thermoplastic polymer and a second thermoplastic polymer arranged in distinct zones across a cross-section of individual bicomponent filaments;

the first and second thermoplastic polymers being incompatible with each other and responsive to a nonmechanical aqueous stimulus to induce separation from each other; and a third component contained within the matrix, the third component selected from the group consisting of fibers, particles, and combinations thereof.

22. A nonwoven web composite according to claim 21, further comprising:

the thermoplastic filaments being substantially continuous.

23. A nonwoven web composite according to claim 22, further comprising:

the third component being an absorbent material.

24. A nonwoven web composite according to claim 21, further comprising:

the third component being an absorbent material.

* * * * *